US011708247B2

(12) United States Patent
Boerboom

(10) Patent No.: US 11,708,247 B2
(45) Date of Patent: Jul. 25, 2023

(54) CONTAINER SPREADER FOR LINKING A CONTAINER WITH A HOISTING INSTALLATION

(71) Applicant: VDL CONTAINERSYSTEMEN BV

(72) Inventor: Olaf Johannes Boerboom, Lommel (BE)

(73) Assignee: VDL CONTAINERSYSTEMEN BV, Hapert (NL)

( * ) Notice: Subject to any disclaimer, the term of this patent is extended or adjusted under 35 U.S.C. 154(b) by 784 days.

(21) Appl. No.: 16/619,615

(22) PCT Filed: Jun. 1, 2018

(86) PCT No.: PCT/NL2018/050359
§ 371 (c)(1),
(2) Date: Dec. 5, 2019

(87) PCT Pub. No.: WO2018/226093
PCT Pub. Date: Dec. 13, 2018

(65) Prior Publication Data

US 2020/0140238 A1 May 7, 2020

(30) Foreign Application Priority Data

Jun. 6, 2017 (NL) ..... 2019025

(51) Int. Cl.
*B66C 1/66* (2006.01)
*F15B 11/02* (2006.01)
(Continued)

(52) U.S. Cl.
CPC ..... *B66C 1/663* (2013.01); *B66C 13/14* (2013.01); *F15B 11/02* (2013.01); *B66C 3/16* (2013.01)

(58) Field of Classification Search
CPC . B66C 1/663; B66C 3/16; B66C 13/14; F15B 11/02
See application file for complete search history.

(56) References Cited

U.S. PATENT DOCUMENTS 6,863,325 B1 * 3/2005 Mills ..... B66C 1/663 294/81.53
2012/0139274 A1 * 6/2012 Fleischer ..... B66C 1/101 294/67.3

(Continued)

FOREIGN PATENT DOCUMENTS

CN 101927948 A 12/2010
CN 102745590 A 10/2012

(Continued)

OTHER PUBLICATIONS

International Search Report, dated Oct. 9, 2018, from corresponding PCT application No. PCT/NL2018/050359.

(Continued)

*Primary Examiner* — Glenn F Myers
(74) *Attorney, Agent, or Firm* — Nixon & Vanderhye

(57) ABSTRACT

A container spreader for coupling a container with a hoisting installation has a number of assemblies of a guiding plate and a displacing device connected thereto, for displacing the guiding plate between an active position A and an inactive position B. The displacement device has a hydraulic swivel motor provided with an output shaft which is connected to the guide plate via connecting elements. A hydraulic unit is coupled to the swivel motor via coupling device for supplying and discharging hydraulic oil from and to the swivel motor. By applying a hydraulic swivel motor, a final transmission can be omitted and no valves are required for keeping the hydraulic motor at pressure. As a result, an energy-efficient and inexpensive assembly has been obtained.

4 Claims, 2 Drawing Sheets

(51) Int. Cl.
*B66C 13/14* (2006.01)
*B66C 3/16* (2006.01)

(56) References Cited

U.S. PATENT DOCUMENTS

2015/0360914 A1* 12/2015 Lamrouex ..... B66C 1/101
29/428
2016/0376131 A1* 12/2016 Illana Martos .... B65D 90/0013
294/81.53

FOREIGN PATENT DOCUMENTS

JP H06-255978 A 9/1994
WO 2007/084052 A1 7/2007
WO 2010/021596 A1 2/2010

OTHER PUBLICATIONS

Written Opinion, dated Oct. 9, 2018, from corresponding PCT application No. PCT/NL2018/050359.

* cited by examiner

CONTAINER SPREADER FOR LINKING A CONTAINER WITH A HOISTING INSTALLATION

TECHNICAL FIELD OF THE INVENTION

The invention relates to a container spreader for coupling a container with a hoisting installation, comprising a lifting frame provided with coupling means for coupling to the hoisting installation, and a number of guide plates connected to the lifting frame for guiding the container spreader during coupling of the container spreader with a container, which guide plates are each connected to a separate hydraulic swivel motor which can move the guide plate connected thereto between an active position, in which the guide plates guide the container spreader to the container, and an inactive position, in which the guide plates are folded away so that they cannot come into contact with the container.

BACKGROUND OF THE INVENTION

Such a container spreader is known, inter alia, from ST20-STS Separating Twin-Twenty Expandable Spreader (EARLS INDUSTRIES) 2013; (see http://earlsindustries-.com/portfolio/separating-twin-twentycontainer-spreader/gallery/shipping-container-handling/). It is customary to connect all swivel motors of such a container spreader to one hydraulic pump which is driven by an electric motor and is connected to the swivel motors via hydraulic lines. Hydraulic control valves are located between the hydraulic pump and the swivel motors for running the hydraulic swivel motors and for determining their direction of rotation. These control valves are usually mounted against the swivel motors and are connected to the hydraulic pump via hydraulic lines. With such a container spreader the hydraulic system is of such a nature that the hydraulic pump is in continuous operation in order to be able to carry out this function and eventually other functions directly. The disadvantage of this well-known container spreader is that it continuously consumes energy, continuously produces noise and is continuously subject to wear and tear. A further disadvantage of this known container spreader is that if one of the hydraulic lines gets a leak, the hydraulic fluid (usually oil) flows into the environment, which can have serious adverse consequences.

SUMMARY OF THE INVENTION

An object of the invention is to provide a container spreader of the type described in the preamble which does not have the abovementioned drawbacks of the known container spreader. More in particular, an object of the invention is to provide a container spreader which requires less energy for moving the guide plates, produces less noise and is less subject to wear than the known container spreader. To this end, the container spreader according to the invention is characterized in that each hydraulic swivel motor is connected to a separate hydraulic pump which is connected to a separate electric motor, the hydraulic swivel motor with the hydraulic pump and the electric motor forming an assembly, and wherein each assembly is connected to one of the guide plates. A relatively small swivel motor can already deliver a large torque to the output shaft with relatively little displacement of hydraulic fluid. For the drive of a hydraulic swivel motor, little pump energy (for the supply of hydraulic fluid) is required. As a result, for controlling one swivel motor, it is sufficient to use a relatively small hydraulic pump and thus also a light electric motor that requires little energy. Due to the small hydraulic circuit and short lines, it is sufficient to have an embodiment in which the electric motor is only switched on if movement of the guide plate is desired. As a result, the container spreader according to the invention is energy-efficient. In order to change the direction of movement of the guide plate, it is sufficient to change the direction of rotation of the electric motor, as a result of which the hydraulic-electric assembly according to the invention behaves the same as a known mechanical-electrical assembly.

An embodiment of the container spreader according to the invention is characterized in that each guide plate is connected via a connecting element directly to the output shaft of the hydraulic swivel motor of the assembly. By connecting the guide plate without the intervention of a transmission to the output shaft of the hydraulic swivel motor, a transmission is saved and no losses occur in the transmission.

A further embodiment of the container spreader according to the invention is characterized in that hydraulic valves are provided in each assembly between the hydraulic pump and the hydraulic swivel motor for holding the guide plate, respectively for limiting the load on the guide plate and for limiting the maximum torque of the swivel motor. Preferably, these hydraulic valves are adjustable.

The guide plates can be present at the corners of the container spreader. In that case, the guide plates are preferably bent in the transverse direction so that they have an L-shaped cross-section and come into contact with the container both at the transverse side and at the longitudinal side of the container for the purpose of aligning and guiding the container spreader with respect to the container. The guide plates can also be located at the head and long sides of the frame, with at least one guide plate on each side and two guide plates preferably on the long side of the frame. In this case, the guide plates are preferably straight in the transverse direction.

BRIEF DESCRIPTION OF THE DRAWINGS

The invention will be further elucidated below on the basis of drawings. These drawings show an embodiment of the container spreader according to the present invention. In the drawings.

DETAILED DESCRIPTION OF THE DRAWINGS

Figure 1:
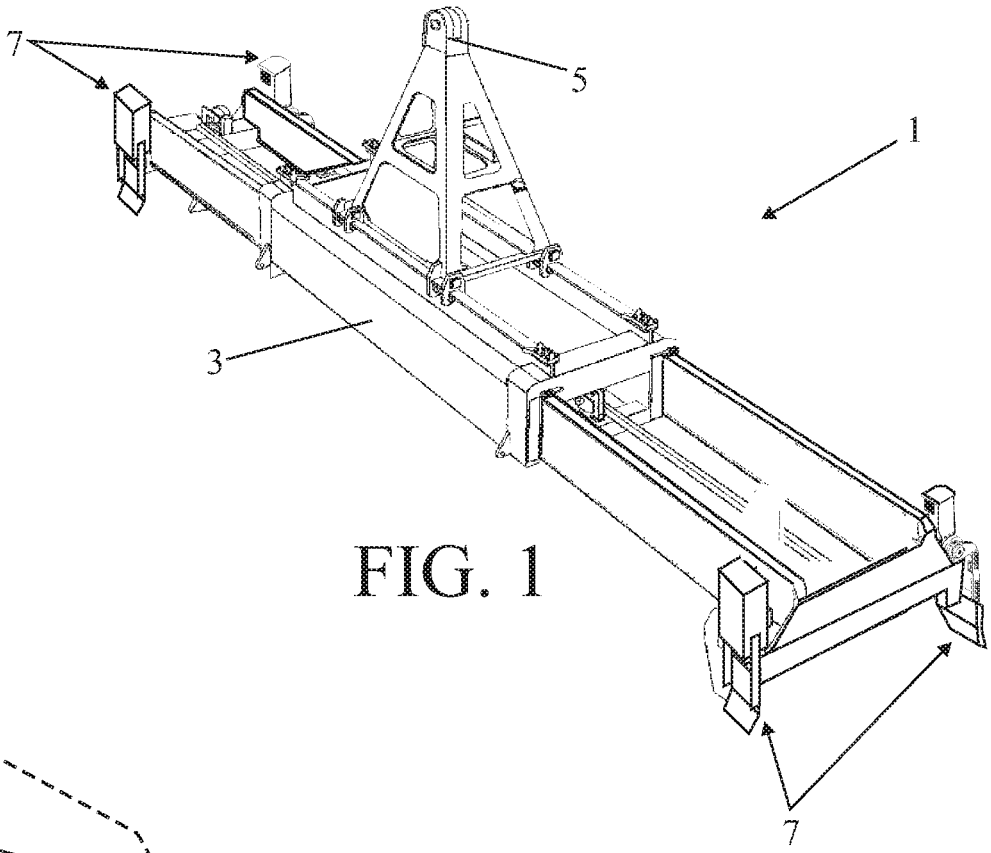
FIG. 1 shows a container spreader according to the invention with four assemblies.

FIG. 1 shows a container spreader 1 for coupling a container with a hoisting installation. The container spreader has a lifting frame 3 provided with coupling means 5 for coupling to the hoisting device and a number of assemblies 7 connected to the lifting frame. Each assembly is formed by a guide plate 9 and a displacement device 11 connected thereto, for moving the guide plate. In this embodiment each guide plate is formed by a flat plate which is slightly kinked about a horizontal line near the center.

Figure 2:
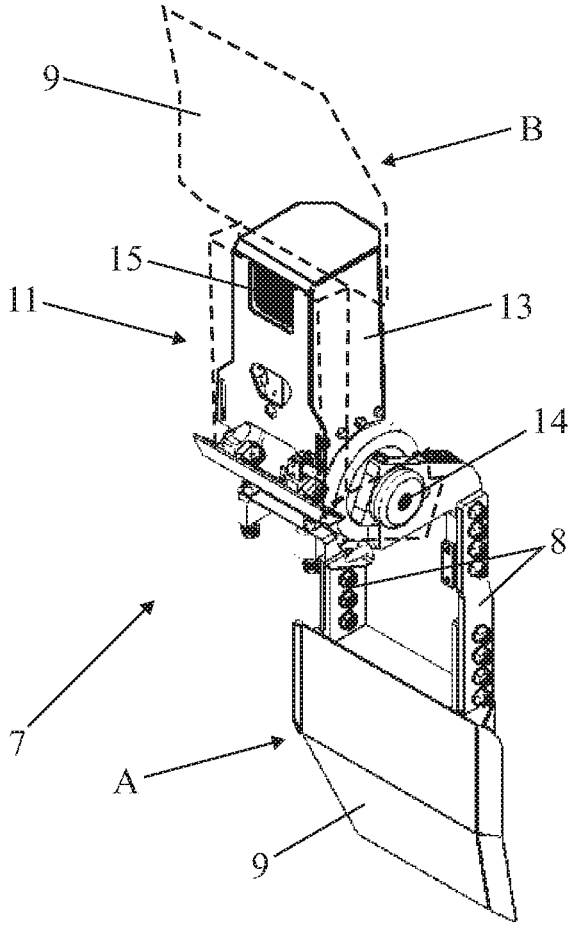
FIG. 2 shows the swivel motor of one of the assemblies with a flat guide plate connected thereto.

FIG. 2 shows the displacement device 11 with a guide plate 9 connected thereto. The guide plate is movable between an active position A, in which the guide plate guides the container spreader to the container, and an inactive position B (indicated by broken lines), in which the guide plate is folded away so that it cannot come into contact with the container. The displacement device 11 has a hydraulic swivel motor 13 provided with an output shaft 14 which is connected to the guide plate 9 via connecting elements 8. The displacement device furthermore has a hydraulic unit (not shown in this figure) for supplying and removing hydraulic oil from and to the swivel motor 13. This hydraulic unit is coupled to the swivel motor via coupling device 15.

Figure 3:
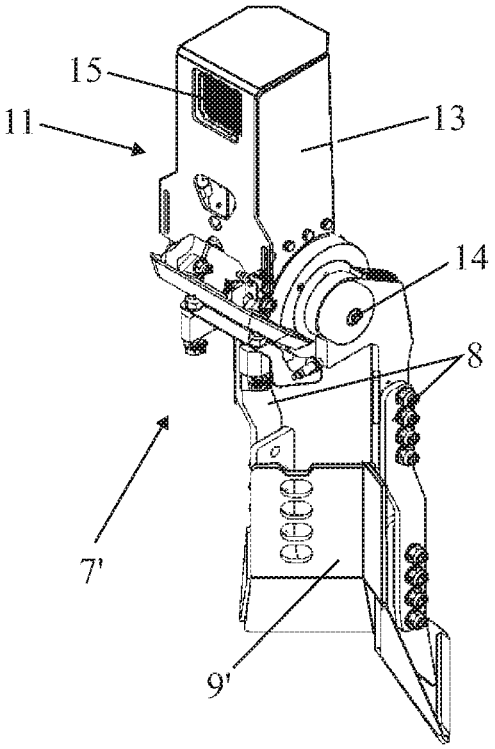
FIG. 3 shows the swivel motor of one of the assemblies with a bent guide plate which is connected to it and is connected thereto.

The assembly 7 shown in FIG. 2 has a flat guide plate 9 and is intended for placement along the longitudinal or transverse side of the lifting frame 3. The assembly can also be designed to guide the container spreader at the corner points. FIG. 3 shows an assembly 7 'with a guide plate 9' with an L-shaped cross-section so that at a corner of the container it is in contact with both the longitudinal side and the transverse side of the container.

Figure 4:
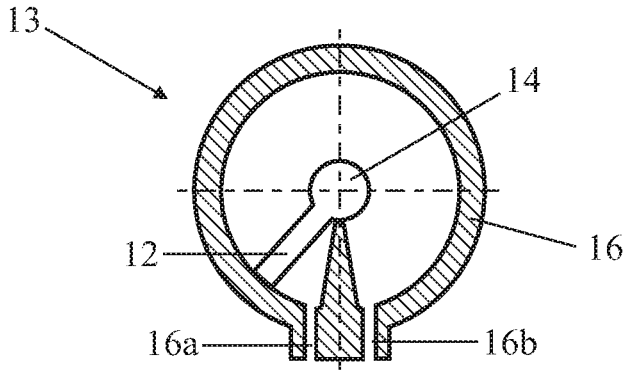
FIG. 4 is a schematic representation of a swivel motor.

To illustrate the operation of a swivel motor, a schematic representation of a swivel motor 13 in cross-section is shown in FIG. 4. By pumping hydraulic fluid through one of the openings 16*a* in the housing 16 of the swivel motor, the baffle 12 attached to the output shaft 14 is rotated and the hydraulic fluid present on the other side of the baffle flows, via the other opening 16*b* in the housing, outwards. By reversing the liquid flow, the baffle 12 rotates in the opposite direction. The output shaft 14 of the swivel motor can thus only rotate through an angle smaller than 360 degrees. By closing the two openings 16*a* and 16*b*, the baffle 12 and thus the outgoing axis 14 are fixed.

Figure 5:
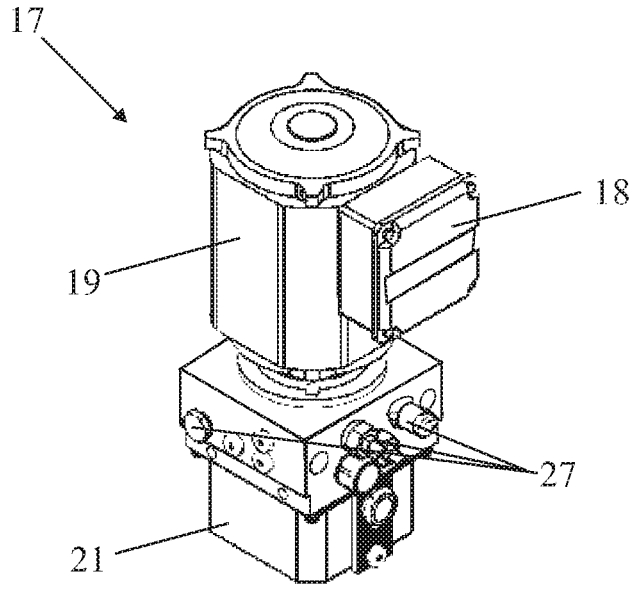
FIG. 5 shows the hydraulic unit for the swivel motor.

In FIG. 5 the hydraulic unit 17 is shown. The hydraulic unit has a two-way electric motor 19 which drives a hydraulic pump 21 via a valve block 18. This pump can be coupled to the coupling device 15 of the swivel motor 13.

Figure 6:
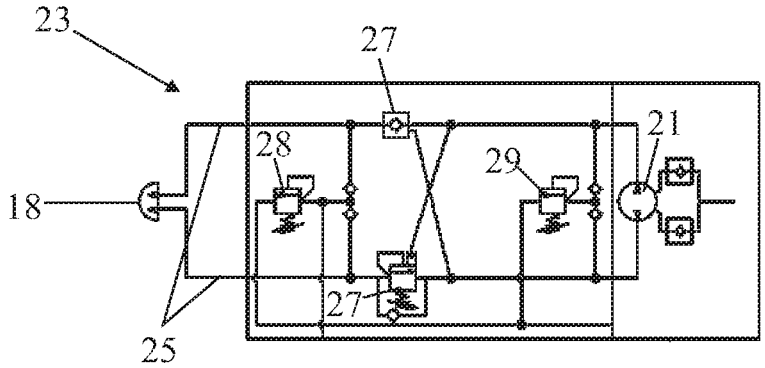
FIG. 6 shows the diagram of the hydraulic unit.

FIG. 6 shows the scheme 23 of the hydraulic unit 17. The hydraulic pump 21 is coupled via hydraulic lines 25 and hydraulic valves 27-29, present in the valve block 18, with a coupling device 20 which can be coupled to the coupling device 15 of the swivel motor 13. The hydraulic valves 27 serve to keep the guide plate in the position in which it is set. The hydraulic valve 28 is designed to ensure that the load on the guide plate is limited in the case of a mechanical load from the outside and the hydraulic valve 29 is designed to limit the maximum torque of the swivel motor in order to prevent overloading of the hydraulic pump and electric motor. The hydraulic valves 27-29 are adjustable.

Although the present invention is elucidated above on the basis of the given drawings, it should be noted that this invention is not limited whatsoever to the embodiments shown in the drawings. The invention also extends to all embodiments deviating from the embodiments shown in the drawings within the context defined by the claims.

The invention claimed is:

1. A container spreader for coupling a container with a hoisting installation, the container spreader comprising:

a lifting frame provided with coupling means for coupling to the hoisting installation, and a number of guide plates connected to the lifting frame for guiding the container spreader during coupling of the container spreader with the container, which guide plates are each connected to a separate hydraulic swivel motor which can move the guide plate connected thereto between an active position (A), in which the guide plates guide the container spreader to the container, and an inactive position (B), in which the guide plates are folded away so that they cannot come into contact with the container, wherein each hydraulic swivel motor is connected to a separate hydraulic pump which is connected to a separate electric motor, the hydraulic swivel motor with the hydraulic pump and the electric motor forming an assembly, wherein each assembly is connected to one of the guide plates, and wherein each guide plate is connected via a connecting element directly to the output shaft of the hydraulic swivel motor of the assembly.

2. The container spreader according to claim 1, wherein hydraulic valves are provided in each assembly between the hydraulic pump and the hydraulic swivel motor for holding the guide plate, respectively for limiting the load on the guide plate and for limiting the maximum torque of the swivel motor.

3. The container spreader according to claim 2, wherein the hydraulic valves) are adjustable.

4. The container spreader according to claim 1, wherein hydraulic valves are provided in each assembly between the hydraulic pump and the hydraulic swivel motor for holding the guide plate, respectively for limiting the load on the guide plate and for limiting the maximum torque of the swivel motor.

* * * * *